US007257145B2

(12) United States Patent
Griffin et al.

(10) Patent No.: US 7,257,145 B2
(45) Date of Patent: Aug. 14, 2007

(54) SPECTROSCOPY-BASED SAFETY SYSTEM AND METHOD FOR A VACUUM ARC REMELT FURNACE

(75) Inventors: LaVar Ellis Griffin, Hooper, UT (US); Lonny Dean Severson, Hooper, UT (US)

(73) Assignee: Westinghouse Electric Co LLC, Pittsburgh, PA (US)

( * ) Notice: Subject to any disclaimer, the term of this patent is extended or adjusted under 35 U.S.C. 154(b) by 0 days.

(21) Appl. No.: 11/143,178

(22) Filed: Jun. 2, 2005

(65) Prior Publication Data

US 2006/0291522 A1 Dec. 28, 2006

(51) Int. Cl.
*H05B 7/148* (2006.01)

(52) U.S. Cl. ..... 373/42; 373/70

(58) Field of Classification Search ..... 373/42, 373/47, 49, 67, 70, 50, 102, 105; 340/605; 356/313

See application file for complete search history.

(56) References Cited

U.S. PATENT DOCUMENTS 3,672,774 A * 6/1972 Bojic et al. ..... 356/313
5,210,526 A * 5/1993 Imperiali ..... 340/605
5,621,751 A * 4/1997 Williamson et al. ..... 373/70

* cited by examiner

*Primary Examiner*—Quang Van

(57) ABSTRACT

A vacuum arc remelt furnace system that automatically monitors for electrode to crucible arcing in a VAR furnace. The vacuum arc remelt furnace system includes a crucible, an electrode provided within the crucible, and a spectrometer operatively coupled to the gap between the electrode and the crucible. The spectrometer detects the presence of one or more copper-specific light wavelengths in light that is present in the gap, and preferably generates an alarm and/or shuts the furnace down depending upon what is detected. Also, a method of operating a vacuum arc remelt furnace to automatically monitor for electrode top crucible arcing. The method includes collecting light that is present in the gap between the crucible and said electrode, and determining whether one or more copper-specific light wavelengths are present in the light. An alarm is generated and/or the furnace is shut down depending upon what is detected.

13 Claims, 1 Drawing Sheet

SPECTROSCOPY-BASED SAFETY SYSTEM AND METHOD FOR A VACUUM ARC REMELT FURNACE

BACKGROUND OF THE INVENTION

1. Field of the Invention

The present invention relates generally to vacuum arc remelting, and more particularly to a spectroscopy-based safety system for a vacuum arc remelt furnace.

2. Description of the Related Art

Vacuum arc remelting (VAR) is a process utilized throughout the specialty metals industry to produce high-quality ingots, such as, for example, specialty steel ingots, nickel-based superalloy ingots and titanium alloy ingots. In vacuum arc remelting, a consumable alloy electrode, typically having a cylindrical shape, is lowered into a VAR furnace that includes a water-cooled copper crucible. A starting material, such as a collection of metal chips, is provided at the bottom of the crucible. The VAR furnace is evacuated and a dc arc is struck between the electrode and the starting material. The heat from the arc continuously melts the tip of the electrode as it is translated downwardly within the crucible, causing molten metal to drip off of the tip of the electrode and into the bottom of the crucible where it solidifies. As the droplets of molten metal fall, high vapor pressure elements and entrapped gasses are removed as a result of the vacuum condition inside the furnace. The objective of VAR is to produce ingots that are free of microstructure and chemical composition defects that are often associated with uncontrolled solidification during casting.

Sometimes during operation of a VAR furnace, the electrode arcs to the water-cooled copper casting crucible. This type of arcing is dangerous because, under certain conditions, it can lead to a steam/hydrogen explosion inside the VAR furnace. For safety reasons, the existence and level of such arcing must be constantly monitored. Currently, electrode to crucible arcing is manually monitored by an operator by visually observing the VAR furnace. As will be appreciated, such manual monitoring is susceptible to human error. Thus, there is a need for an automated system and method for monitoring for electrode to crucible arcing in a VAR furnace.

SUMMARY OF THE INVENTION

The present invention relates to a vacuum arc remelt furnace system that automatically monitors for electrode to crucible arcing in a VAR furnace. The vacuum arc remelt furnace system includes a crucible, an electrode provided within the crucible, and a spectrometer operatively coupled to the gap between the electrode and the crucible. The spectrometer detects the presence of one or more copper-specific light wavelengths in light that is present in the gap. The spectrometer may be operatively coupled to the gap by one or more fiber optic cables that transmit the light that is present in the gap to the spectrometer. In addition, one or more lenses are preferably provided for focusing the light into the one or more fiber optic cables. Preferably, the one or more fiber optic cables comprise two fiber optic cables spaced about 180° apart around the electrode, and the one or more lenses comprise two lenses spaced about 180° apart around the electrode.

In addition, the vacuum arc remelt furnace system according to the invention also includes a computer control system in electronic communication with the spectrometer, wherein the spectrometer generates and transmits to the computer control system a signal indicating an intensity of each of the one or more copper-specific light wavelengths present in the light for the gap between the electrode and the crucible. In this case, the computer control system may generate an alarm when the intensity of any of the one or more copper-specific light wavelengths is determined to be above a first threshold level, such as zero. In addition, the computer control system may also cause the vacuum arc remelt furnace system to shut down when the intensity of any of the one or more copper-specific light wavelengths is determined to be above a second threshold level.

The one or more copper-specific light wavelengths may be one or more of 324.75 nm, 327.40 nm, 224.70 nm, 223.01 nm, 219.96 nm, 221.81 nm, 222.78 nm, 217.89 nm, 216.51 nm, 218.17 nm, 213.60 nm, 219.23 nm, 221.46 nm, 229.27 nm and 200.00 nm. Preferably, the copper-specific light wavelengths is about 224.70 nm.

The present invention also relates to a method of operating a vacuum arc remelt furnace having a crucible and an electrode to automatically monitor for electrode to crucible arcing. The method includes collecting light that is present in the gap between the crucible and the electrode, and determining whether one or more copper-specific light wavelengths are present in the light. The determining step may comprise determining an intensity of each of the one or more copper-specific light wavelengths present in said light. The method may also include generating an alarm when the intensity of any of the one or more copper-specific light wavelengths is determined to be above a first threshold level, such as zero. In addition, the method may also include shutting the furnace down when the intensity of any of the one or more copper-specific light wavelengths is determined to be above a second threshold level.

BRIEF DESCRIPTION OF THE DRAWINGS

A further understanding of the invention can be gained from the following Description of the Preferred Embodiments when read in conjunction with the accompanying drawings in which.

DESCRIPTION OF THE PREFERRED EMBODIMENTS

Figure 1:
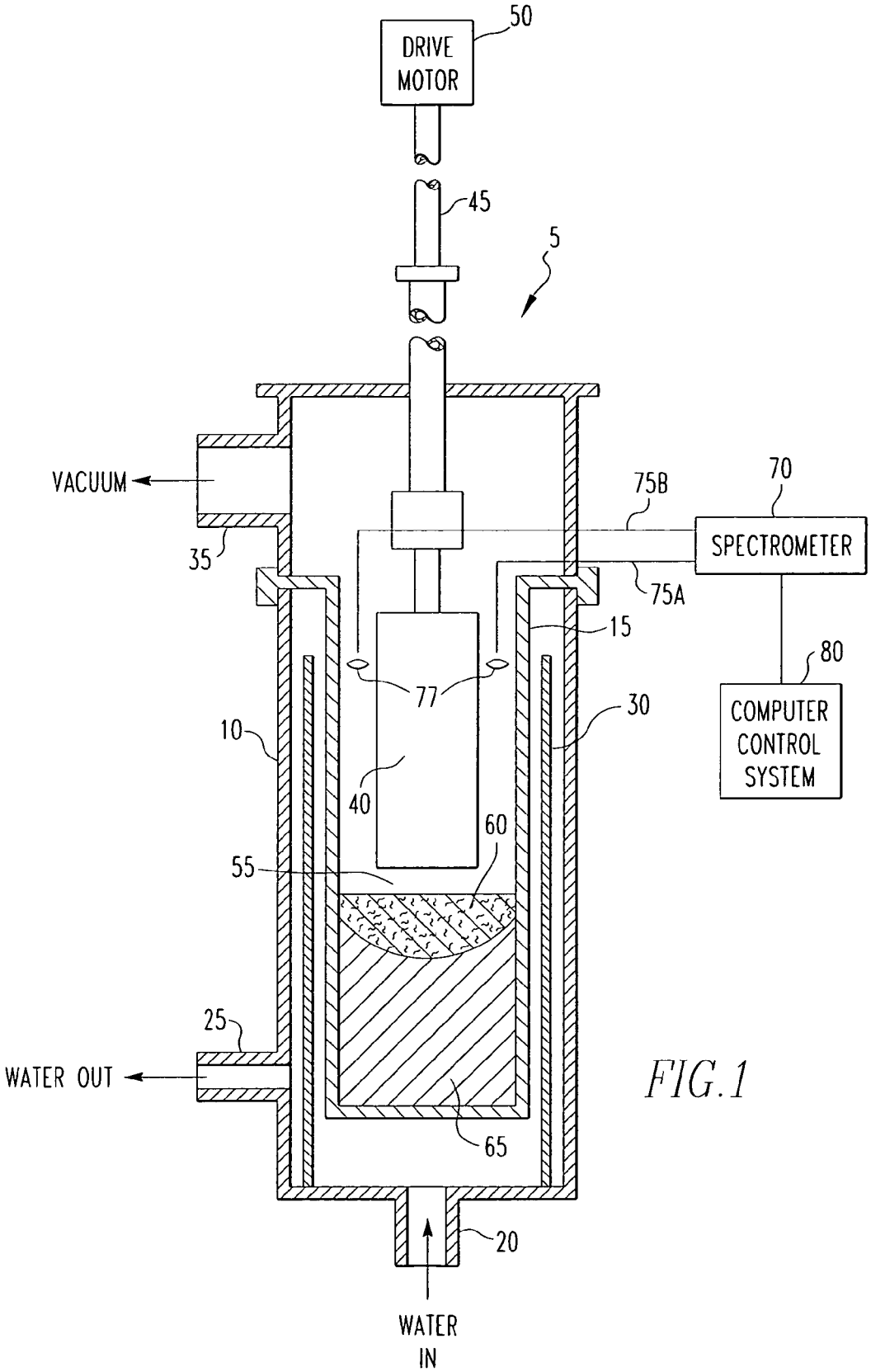
FIG. 1 is a schematic representation of a VAR furnace including a spectroscopy-based safety system according to the present invention.

FIG. 1 is a schematic illustration of VAR furnace system 5 according to the present invention. VAR furnace system 5 includes furnace body 10 which houses crucible 15, typically made of copper. Furnace body 10 includes water inlet 20 and water outlet 25 and houses water guide 30, all of which cooperate to cool crucible 15 by passing water over crucible 15. Furnace body 10 also includes vacuum port 35 for evacuating the interior of furnace body 10. Electrode 40 is selectively lowered inside crucible 15 by drive screw 45 and drive motor 50 to maintain an appropriate electrode gap 55 required for the VAR process. Electrode 40 typically has a cylindrical shape and is made of the metal material that is to be cast during the VAR process.

In operation, the interior of furnace body 10 is evacuated through vacuum port 35, and an arc is struck between electrode 40 and a starting material (not shown) provided in the bottom of crucible 15 by reducing the gap between the starting material (not shown) and the electrode 40 sufficiently to allow the applied voltage to conduct current across the gap via the arc. The heat of the arc melts the tip of electrode 40, causing molten metal to drip downward and form ingot pool 60. As the molten metal in ingot pool 60 cools, it forms solidified ingot 65. As the droplets of molten metal fall, high vapor pressure elements and entrapped gasses are removed from the metal through vacuum port 35 provided in furnace body 10.

As noted above, it is possible that during operation of VAR furnace system 5, the electrode 40 may arc to crucible 15, thereby creating a dangerous condition that could lead to catastrophic failure of the VAR furnace system 5. As is known in the field, when electrode 40 arcs to crucible 15, light of a copper-specific wavelength will be generated as a result of the ionization of the copper of crucible 15. The light that is produced during arcing includes light of one or more of the following wavelengths: 324.75 nm, 327.40 nm, 224.70 nm, 223.01 nm, 219.96 nm, 221.81 nm, 222.78 nm, 217.89 nm, 216.51 nm, 218.17 nm, 213.60 nm, 219.23 nm, 221.46 nm, 229.27 nm and 200.00 nm.

Thus, as seen in FIG. 1, VAR furnace system 5 is, according to the present invention, provided with spectrometer 70 for automatically monitoring furnace body 10 for an electrode 40 to crucible 15 arc condition. Specifically, spectrometer 70 is operatively coupled to furnace body 10 (in particular the gap between electrode 40 and crucible 15) by fiber optic cables 75A and 75B or other similar means. As is known in the field, spectrometer 70 is capable of measuring the intensity of collected radiation (light) as a function of wavelength and may be used to determine the particular wavelengths of various collected light. In VAR furnace system 5, light from the interior of furnace body 10, and in particular from the gap between electrode 40 and crucible 15, is focused by lenses 77 into fiber optic cables 75A and 75B, and is efficiently transmitted thereby to the spectrometer 70. In the preferred embodiment shown in FIG. 1, two lenses 77 spaced about 180° apart around the perimeter of electrode 40 are used to focus light from the interior of furnace body 10 into two similarly positioned fiber optic cables 75A and 75B. It will be appreciated, however, that more or less lenses and/or fiber optic cables may be used without departing from the scope of the present invention.

Spectrometer 70 is programmed to detect and quantify the intensity of any light collected from the gap between electrode 40 and crucible 15 that is of one or more copper-specific wavelengths. For example, spectrometer 70 may be programmed to detect and quantify the intensity of any light having a wavelength of one or more of the values specified above. In the preferred embodiment, spectrometer 70 is programmed to detect and quantify the intensity of any light having a wavelength of about 224.70 nm. A suitable example of spectrometer 70 is the HR2000 High Resolution Spectrometer available from Ocean Optics, Inc. of Dunedin Fla.

As seen in FIG. 1, spectrometer 70 is in electronic communication with computer control system 80, which is the computer system that controls operation of VAR furnace system 5. Spectrometer 70 continuously transmits a signal to computer control system 80 that indicates the measured intensity level (which could be zero) of light detected at each of the particular, pre-selected wavelengths. Computer control system 80 is programmed to monitor this signal and generate an alarm signal for an operator when the detected intensity level of any of the wavelengths is determined to be above a first threshold level (indicating that some degree of arcing is occurring), and generate an alarm and shut down operation of VAR furnace system 5 (i.e., stop the VAR process) when the detected intensity level of any of the wavelengths is determined to be above a second threshold level (wherein a dangerous condition exists). Appropriate particular first and second threshold levels for a particular application may be determined through testing (particular values have not yet been determined by the present inventors). In one embodiment, the first threshold level is set to zero, meaning an alarm is generated when any light at all of any of the wavelengths is detected. In this embodiment, the second threshold level is set to some higher value determined to be significant enough to warrant a shut down of the VAR process.

Thus, the present invention provides an automated system and method for detecting electrode to crucible arcing in a VAR furnace using spectroscopy techniques. As a result, safety and performance of VAR furnaces and processes may be improved.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A vacuum arc remelt furnace system, comprising:

a crucible;

an electrode provided within said crucible, said crucible and said electrode having a gap therebetween;

a spectrometer operatively coupled to said gap, said spectrometer detecting the presence of one or more copper-specific light wavelengths in light that is present in said gap; and a computer control system in electronic communication with said spectrometer, wherein said spectrometer generates and transmits to said computer control system a signal indicating an intensity of each of said one or more copper-specific light wavelengths present in said light and wherein said computer control system generates an alarm when the intensity of any of said one or more copper-specific light wavelengths is determined to be above a first threshold level.

2. A vacuum arc remelt furnace system according to claim 1, said spectrometer being operatively coupled to said gap by one or more fiber optic cables, said one or more fiber optic cables transmitting said light that is present in said gap to said spectrometer.

3. A vacuum arc remelt furnace system according to claim 2, further comprising one or more lenses for focusing said light that is present in said gap into said one or more fiber optic cables.

4. A vacuum arc remelt furnace system according to claim 3, said one or more fiber optic cables comprising two fiber optic cables spaced about 180° apart around said electrode, and said one or more lenses comprising two lenses spaced about 180° apart around said electrode.

5. A vacuum arc remelt furnace system according to claim 1, wherein said computer control system causes said vacuum arc remelt furnace system to shut down when the intensity of any of said one or more copper-specific light wavelengths is determined to be above a second threshold level.

6. A vacuum arc remelt furnace system according to claim 1, wherein said first threshold level is zero.

7. A vacuum arc remelt furnace system according to claim 1, wherein said one or more copper-specific light wavelengths comprise one or more of 324.75 nm, 327.40 nm, 224.70 nm, 223.01 nm, 219.96 nm, 221.81 nm, 222.78 nm, 217.89 nm, 216.51 nm, 218.17 nm, 213.60 nm, 219.23 nm, 221.46 nm, 229.27 nm and 200.00 nm.

8. A vacuum arc remelt furnace system according to claim 1, wherein said one or more copper-specific light wavelengths is about 224.70 nm.

9. A method of operating a vacuum arc remelt furnace having a crucible and an electrode, comprising:

collecting light that is present in a gap between said crucible and said electrode;

determining whether one or more copper-specific light wavelengths are present in said light;

determining an intensity of each of said one or more copper-specific light wavelengths present in said light; and generating an alarm when the intensity of any of said one or more copper-specific light wavelengths is determined to be above a first threshold level.

10. A method according to claim 9, wherein said first threshold level is zero.

11. A method according to claim 9, further comprising shutting said furnace down when the intensity of any of said one or more copper-specific light wavelengths is determined to be above a second threshold level.

12. A method according to claim 9, wherein said one or more copper-specific light wavelength comprise one or more of 324.75 nm, 327.40 nm, 224.70 nm, 223.01 nm, 219.96 nm, 221.81 nm, 222.78 nm, 217.89 nm, 216.51 nm, 218.17 nm, 213.60 nm, 219.23 nm, 221.46 nm, 229.27 nm and 200.00 nm.

13. A method according to claim 9, wherein said one or more copper-specific light wavelengths is about 224.70 nm.

* * * * *